US006463636B1

(12) United States Patent
Friedewald

(10) Patent No.: US 6,463,636 B1
(45) Date of Patent: Oct. 15, 2002

(54) SOCK MATE

(76) Inventor: Russell Friedewald, 49 Paradise La., Riverton, IL (US) 62561

( * ) Notice: Subject to any disclaimer, the term of this patent is extended or adjusted under 35 U.S.C. 154(b) by 0 days.

(21) Appl. No.: 09/851,984

(22) Filed: May 10, 2001

(51) Int. Cl.[7] ..... A44B 17/00; A44B 21/00; A41D 27/08

(52) U.S. Cl. ..... 24/573.1; 24/575; 24/578; 24/590; 24/662; 24/DIG. 29; 24/2; 24/239

(58) Field of Search ..... 24/573.1, 578, 24/590, 591, 575, 576, DIG. 29; 2/239

(56) References Cited

U.S. PATENT DOCUMENTS 2,937,834 A * 5/1960 Orenick et al. ..... 24/590
3,699,617 A * 10/1972 Hofmeister ..... 24/DIG. 29
3,729,780 A * 5/1973 White ..... 24/573.1
3,774,267 A 11/1973 Sneider ..... 24/81 D
4,344,240 A * 8/1982 Schiller ..... 24/DIG. 29
4,414,716 A 11/1983 Stastney ..... 24/3
4,962,573 A * 10/1990 Breveglieri ..... 24/573
5,038,413 A * 8/1991 Ursino ..... 2/239
5,321,855 A 6/1994 Ciuffo ..... 2/239
5,490,309 A * 2/1996 Velasquez et al. ..... 24/DIG. 29
5,944,236 A 8/1999 Cinque ..... 223/1
6,032,294 A * 3/2000 Dean ..... 24/662
6,092,241 A * 7/2000 Bellet ..... 24/DIG. 29
6,161,263 A 12/2000 Anderson ..... 24/545

* cited by examiner

*Primary Examiner*—Victor Sakran
(74) *Attorney, Agent, or Firm*—Patent & Trademark Services; Thomas Zack; Joseph H. McGlynn

(57) ABSTRACT

A holder for socks which is barbell shaped when opened and has a snap receiver on one end of the barbell and a snap connector on the other opposite end.

2 Claims, 2 Drawing Sheets

SOCK MATE

BACKGROUND OF THE INVENTION

This invention relates to a sock holder which is shaped like a barbell with a snap receiver and a snap connector.

Keeping mating socks together to easily identify them, especially when washed and/or dried in a machine, has been addressed in a number of earlier inventions. For example, in one such invention a sock holder was comprised of a pair of gripping members which were spring biased in the closed position. Another prior art sock holder discloses a device made of a resilient material with slots for receiving the socks to be held.

Another device discloses a sock holder comprising hook and loop fasteners permanently attached to the socks.

In another sock holder there are spring biased jaws and a hook to suspend the socks.

Still another sock holder has a pair of plastic members with holes there through and into which the socks are attached.

DESCRIPTION OF THE PRIOR ART

Sock holder devices are disclosed in the known in the prior art. For example, U.S. Pat. No. 3,774,267 to Sneider discloses a sock holder comprised of a pair of gripping members which are spring biased in the closed position.

U.S. Pat. No. 4,414,716 to Stastney discloses a device made of a resilient material with slots for receiving the socks to be held.

U.S. Pat. No. 5,321,855 to Ciuffo discloses a sock holder comprising hook and loop fasteners permanently attached to the socks.

U.S. Pat. No. 5,944,236 to Cinque discloses a sock holder with spring biased jaws and a hook to suspend the socks.

U.S. Pat. No. 6,161,263 to Anderson discloses a sock holder that has a pair of plastic members with holes there through and into which the socks are attached.

In the present invention a barbell shaped holder for socks has a snap receiver on one end of the barbell and a snap connector on another part all as will be detailed in the specification that follows hereafter.

SUMMARY OF THE INVENTION

This invention relates to a barbell shaped holder for socks which has a snap receiver on one end of the barbell and a mating snap connector on another part.

It is the primary object of the present invention to provide for an improved way to easily identify a sock mate.

Another object is to provide for such a holder in which the holder is barbell shaped and flexible with a mating snap receiver and a snap connector spaced apart from each other by a flexible connecting member.

These and other objects and advantages of the present invention will become apparent to readers from a consideration of the ensuing description and the accompanying drawings.

DESCRIPTION OF THE PREFERRED EMBODIMENT

Figure 1:
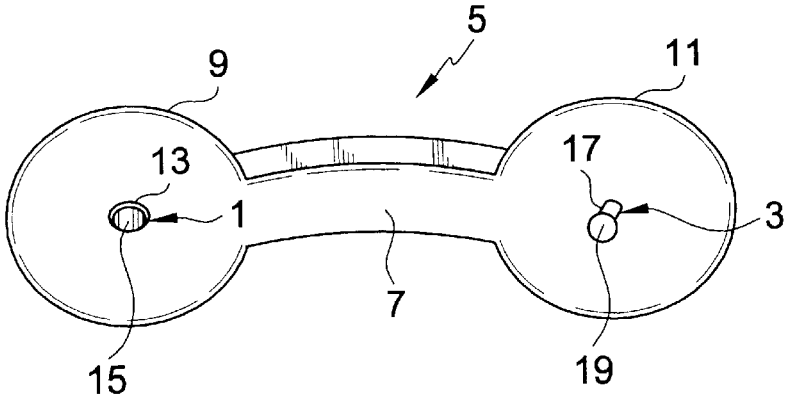
FIG. 1 is a perspective view of the present invention in an opened position showing the snap receiver and snap connector.

FIG. 1 is a perspective view of the present invention in an opened position showing the snap receiver 1 and the mating snap connector 3. The sock holder 5 when in an opened position is generally configured like a barbell with a narrow center connecting portion 7 between two opposite larger end circular disk shaped portions 9 and 11. These two ends are usually of the same size and shape and considerably larger in diameter than the narrower connecting portion 7. Heat resistant plastic material or rust resistant metal, like Red Cross pins, may be used to construct the sock holder. The material selected should not only be water resistant or water proof, but it should have enough inherent flexibility and resiliency to permit the end portions 9 and 11 to be drawn towards each other without any cracking or damage to them or their connecting member 7. Upon release from this drawn closed position, the ends should spring back to the opened position shown in FIG. 1.

The snap receiver 1 consists of a circular lip 13 surrounding a hole or indentation 15 in the end portion 9. The lip is fixed to surface of the end member, here end member 9, on which mounted. The snap receiver 1 may be placed in the center of a circle making up end portion 9. The mating snap connector 3 has a stem fixed to the end portion 11 and extending outwardly from the surface of this end, preferably at the center, with an enlarged spherical free end 19. The enlarged end 19 is just slightly larger in overall diameter than the hole 15 into which it may be fitted and has enough inherent resiliency to permit some compression of its surface to insure the fit will remain tight until pulled apart in the opposite direction.

Figure 2:
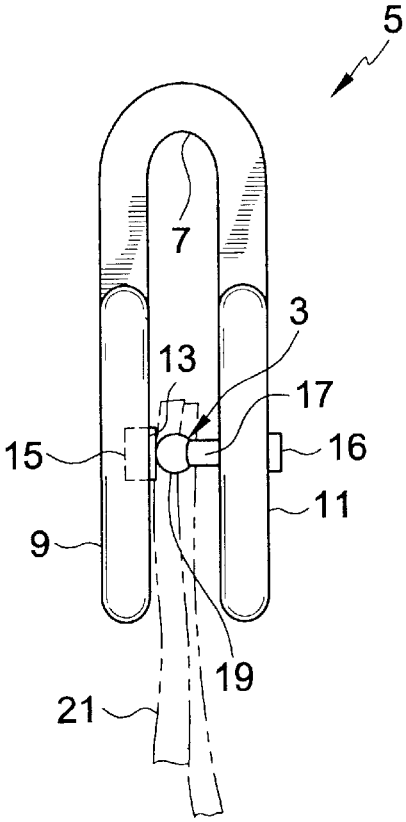
FIG. 2 is side view of FIG. 1 showing the present invention positioned to be closed.

FIG. 2 is side view of FIG. 1 invention showing it positioned just before it is closed. When the snap receiver 1 and lip 13 are just pulled apart from a closed mating position they would appear the same as shown in FIG. 2. The flexible nature of the connecting narrow member 7 is apparent in this figure since it permits the two opposite ends 9 and 11 to be folded into position to face each other. When the end 19 is fully inserted into the hole 15 the two circular shaped ends 9 and 11 are aligned and connected together. If portions of two matching socks 21 are placed between the ends 9 and 11, as shown in dotted line format, the holder 5 will be retained to the socks and keep them together. This retention prevents them from being lost or mislaid when placed in a washing machine or drier. Alternately, one of the two ends 9 or 11 could be permanently fixed to a first sock of a pair of socks allowing the other second sock to be fixed to the first sock at any desired time. Since, the holder is made of a soft flexible material attaching one of the ends near the opened top of the sock will provide little irritation to a wearer and will probably not be noticed when worn. As a second alternate, the outside facing surfaces of one or both of the end of the sock holder could be made with raised surface Braille indicia 16 to permit their easy identification by sight impaired persons.

Figure 3:
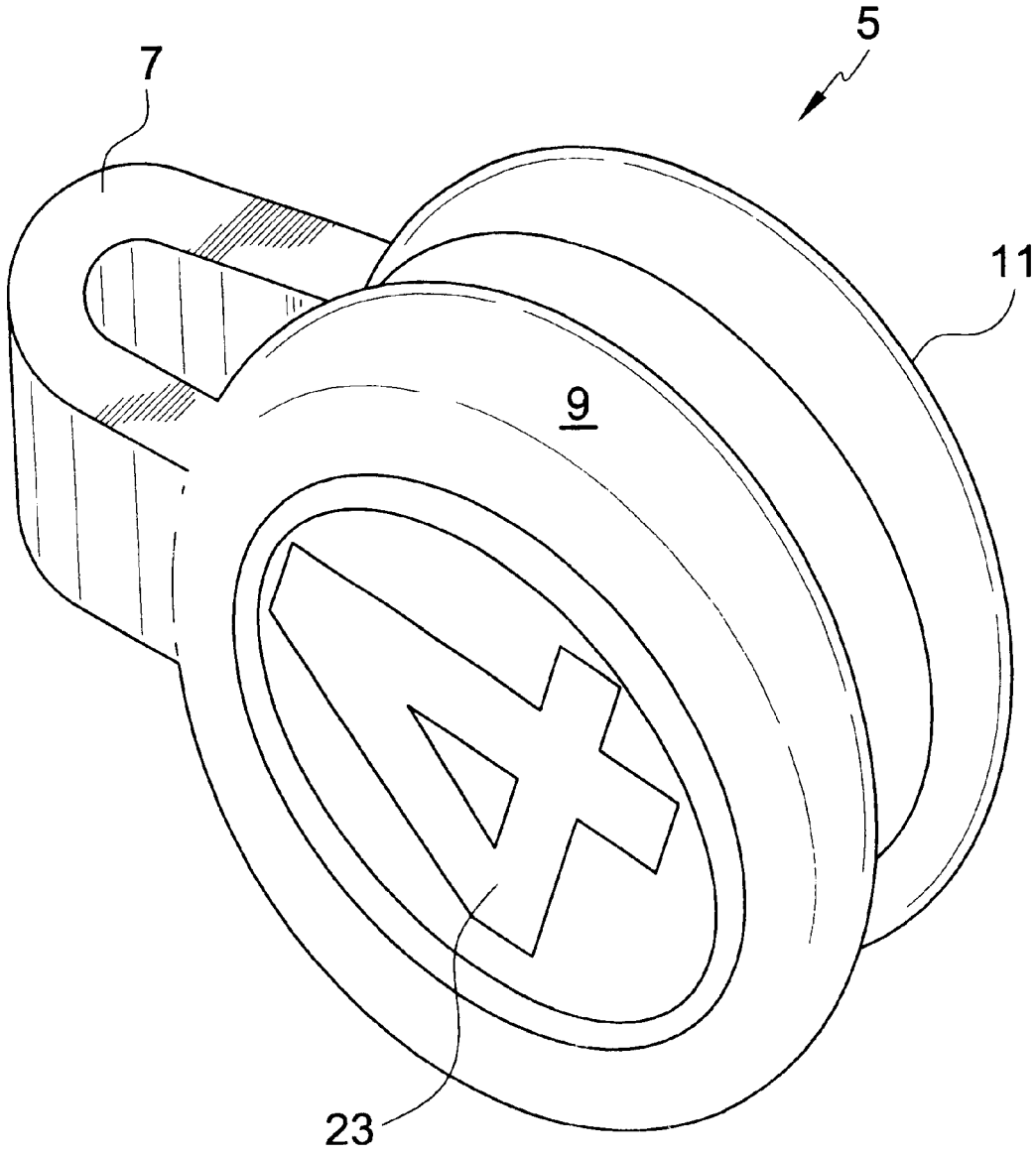
FIG. 3 is a perspective view of the present invention in a closed position.

FIG. 3 is a perspective view of the present invention in a closed position. The center snap receiver 1 and the mating snap connector 3 are not shown in this outer view since then are within the volume between the two ends 9 and 11. Again, the flexible and resilient nature of the connecting member 7 is evident as it is bent into a U-shaped connection. One the facing outer surface of one of the ends, here end 9, has indicia 23 such as a number (here the number four) printed or otherwise place on the facing surface. If desired, different colors may be used to color code different sock holders 5 from each other.

The sock holder can be used not only during the washing cycle but whenever it is desired to keep the two socks of a pair of socks together, such as when storing them. Besides, colors, raised Braille indicia, and indicia having numbering, letters and designs, such as animal figures, symbols or other logos could be placed on the view able outside ends of the holder when closed to distinguish them from other holders or just for aesthetic purposes. Heat resistant rubber could also be used as the material for making the flexible sock holder.

Although the preferred embodiment of the present invention and the method of using the same has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A sock holder comprising:

a flexible connecting member mounted between and fixed to two larger diameter end members, one of said two end members having a snap receiver and the other of said two end members having a snap connector for mating with the snap receiver, each of said two end members being generally circular in shape with the snap receiver and snap connector being generally centered within their respective end member, said snap receiver consisting of a hole within the end member and the snap connector consisting of a stem extending from the end member with an enlarged end portion to engage the hole of the snap receiver to retain the two end members together, the exposed face surfaces of each end member opposite the surfaces with the snap receiver and the snap connector having identifying indicia, said identifying indicia including portions raised from the facing surface of the end member, wherein said snap receiver has a lip encircling the hole of the receiver, said lip being fixed to the surface of the end on which it is mounted.

2. The sock holder as claimed in claim 1, wherein said identifying indicia includes numbers on the outside facing surface of the end member.

* * * * *